US006247339B1

(12) United States Patent
Kenjo et al.

(10) Patent No.: US 6,247,339 B1
(45) Date of Patent: Jun. 19, 2001

(54) WASHING MACHINE

(75) Inventors: Yoshitoyo Kenjo, Osaka; Fumio Ota; Hiroyuki Fujii, both of Hyogo, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/320,135

(22) Filed: May 26, 1999

(30) Foreign Application Priority Data

Jun. 5, 1998 (JP) ..... 10-157280

(51) Int. Cl.[7] ..... D06F 33/02
(52) U.S. Cl. ..... 68/12.04; 68/12.05; 68/12.12
(58) Field of Search ..... 68/12.04, 12.05, 68/12.12, 12.16, 23.5, 53

(56) References Cited

U.S. PATENT DOCUMENTS 5,335,524 * 8/1994 Sakane ..... 68/12.12 X
5,560,061 * 10/1996 Wentzlaff et al. ..... 68/12.12 X
5,743,115 * 4/1998 Hashimoto ..... 68/12.12
6,058,743 * 5/2000 Fujii et al. ..... 68/23.5 X

FOREIGN PATENT DOCUMENTS

2208080 * 2/1989 (GB) ..... 68/23.5
44-2146 7/1975 (JP) .
54-94080 12/1977 (JP) .
61-328295 10/1986 (JP) .
4-220288 8/1992 (JP) .
5-76685 3/1993 (JP) .
7-116378 5/1995 (JP) .

* cited by examiner

*Primary Examiner*—Philip R. Coe
(74) *Attorney, Agent, or Firm*—Wenderoth, Lind & Ponack, L.L.P.

(57) ABSTRACT

A washing basket doubling as a spin-drier is disposed rotatably in a water-tub. A motor drives the basket, which generates centrifugal force. The centrifugal force cause cleansing water to run through the fibers of clothes in the basket, thereby cleansing the clothes. A control device cause variation of the spinning of the basket so that the centrifugal force working on the clothes is varied, which cleanses the clothes more effectively. The clothes in the basket receive only water-moving-force, and they can be cleansed without being damage or entangled.

15 Claims, 8 Drawing Sheets

WASHING MACHINE

FIELD OF THE INVENTION

The present invention relates to a washing machine for cleansing clothes. It relates more particularly to a washing machine that spins a washing basket containing clothes, thereby generating centrifugal force which produces a water stream, and the water stream runs through the clothes, so that soil is removed from the clothes.

BACKGROUND OF THE INVENTION

A conventional washing machine, in general, employs an agitating method. That is, a user puts the clothes into a washing basket doubling as a spin-dryer (hereinafter referred to as a "basket") in the first place, then supplies water into the basket up to a given level. After that, the user agitates the agitator (pulsator) disposed in the basket to cleanse and rinse the clothes.

The agitating is performed by repeating the steps of clockwise spinning, halting, counterclockwise spinning of the pulsator, halting. Respective periods of clockwise spinning and counterclockwise spinning are determined at a given duration so that the clothes are sufficiently agitated. The halt period is also determined at a necessary time for starting the reverse spin after the agitating has been halted.

In this conventional structure, the pulsator agitates the clothes, and the pulsator contacts the clothes directly or via water, thereby revolving the clothes to be cleansed. This structure produces a powerful cleansing effect; however, the clothes directly contact the pulsator, so that the clothes become vulnerable to damage.

Further, the clothes frequently move and revolve up and down, and left and right, whereby the clothes get entangled in a complicated manner with each other. When the clothes get entangled, the centrifugal force due to spinning the basket in the next step, i.e. dehydrating; is impressed to the clothes, whereby the entangled clothes are forcibly stretched and pressed onto an inside wall of the basket. As a result, the clothes lose their shape, and are hard to take out from the basket after the dehydrating step.

SUMMARY OF THE INVENTION

The present invention addresses the problems discussed above and aims to provide a washing machine where only movements of the water only work to on articles to be cleansed so that the articles are kept free from damage and entanglement.

The washing machine of the present invention comprises the following elements:

(a) a water tub;

(b) a washing basket doubling as a spin-drier rotatably disposed in the water tub;

(c) a driving machine for driving the basket; and (d) a control device for controlling the driving machine.

The control device is so structured that it spins the basket, and varies centrifugal force applied to the water in the basket in order to cleanse the articles.

The structure discussed above allows the water stream including detergent to run through the fibers of the clothes thereby removing soil from the articles. As such, because the articles receive only the force due to water movement by the centrifugal force, the articles can be cleansed without damage and entangled.

DETAILED DESCRIPTION OF THE EXEMPLARY EMBODIMENTS

Exemplary embodiments of the present invention are described hereinafter with reference to the accompanying drawings.

Exemplary Embodiment 1

Figure 1:
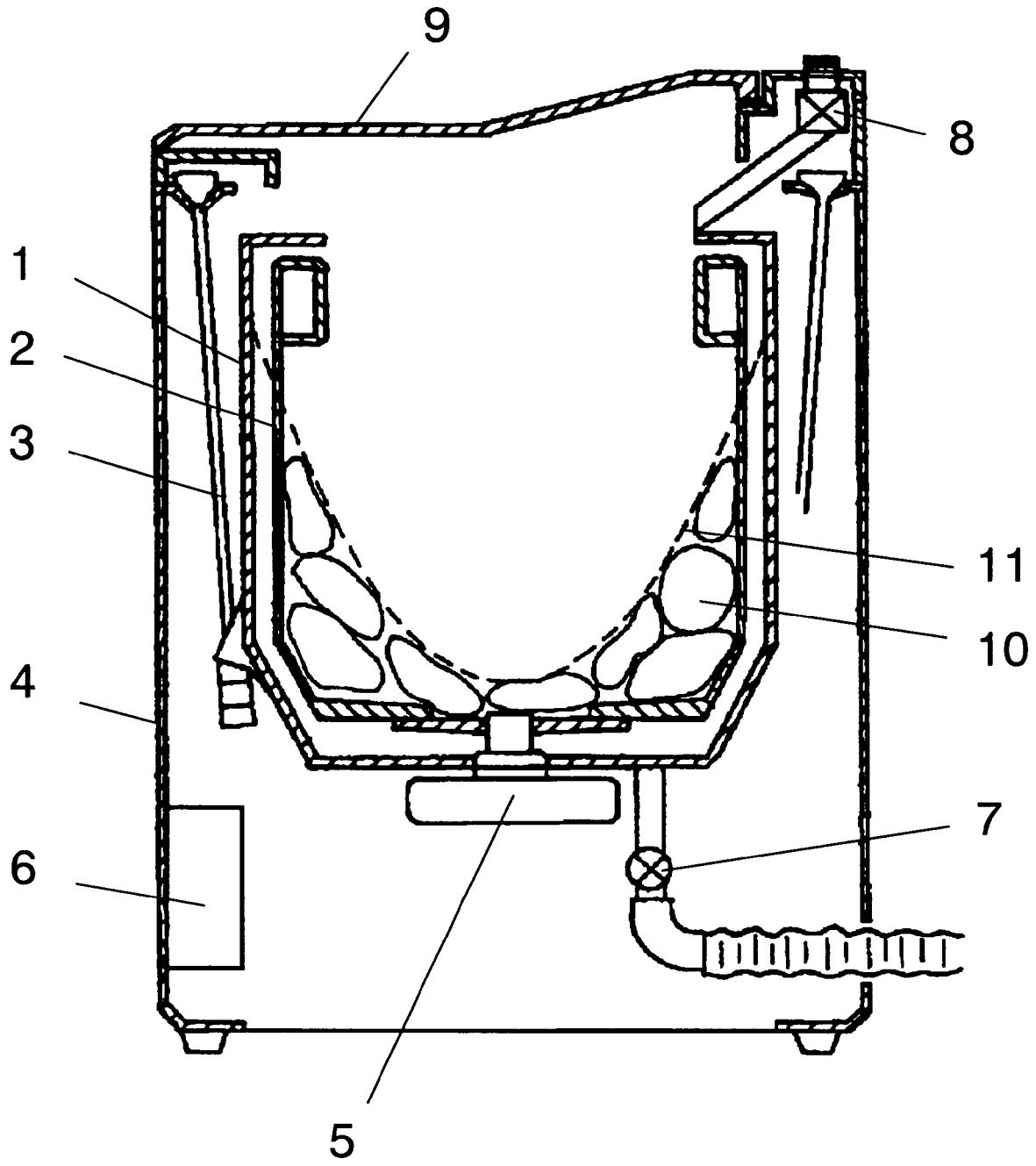
FIG. 1 is a cross section of a washing machine in accordance with a first exemplary embodiment of the present invention.
Figure 2:
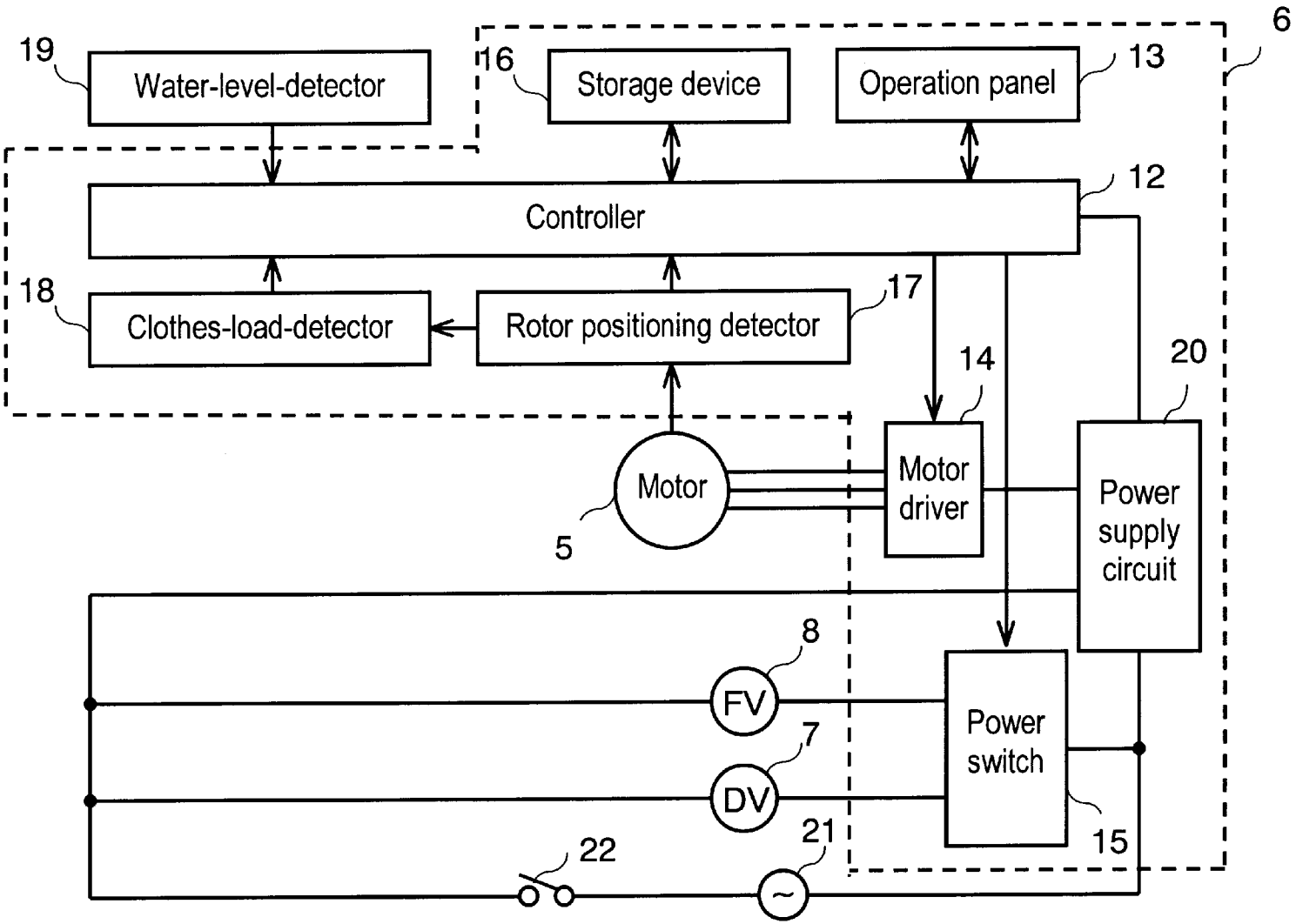
FIG. 2 is a block diagram of a circuit of the washing machine shown in FIG. 1.

FIG. 1 is a cross section of a washing machine in accordance with the first exemplary embodiment of the present invention, and FIG. 2 is a block circuit diagram of the washing machine shown in FIG. 1.

In FIG. 1, a water tub 1 has a washing basket doubling as a spin-drier 2 therein. (Hereinafter the washing basket doubling as a spin-drier 2 is referred to as a "basket 2".) Water tub 1 is suspended by a suspension rod 3 from an outer frame 4 so that vibration due to spinning of the basket and rotating of the driving machine, e.g. motor 5, is restrained.

Motor 5 spins basket 2, and the rotating speed of motor 5 is controlled by a control device 6.

A water valve 8 supplies tap water to water tub 1. A drain valve 7 drains cleansing water in the washing machine outside the machine. A lid 9 covers a top section of basket 2, and articles, e.g. clothes 10 are loaded into basket 2. Spinning basket 2 generates centrifugal force, which works on the cleansing water in the basket, so that the cleansing water rises toward the inner wall of basket 2. As a result, the surface 11 of cleansing water forms a conical shape, in other words, a parabolic line from a cross sectional view in a broken line as shown by a broken line in FIG. 1.

In FIG. 2, control device 6 is structured as follows: a controller 12 comprising a microcomputer controls respective steps of cleansing, rinsing and dehydrating based on a mode set by an instruction through a operation panel 13. To be more specific, controller 12 controls motor 5 via a motor driver 14. Controller 12 also controls water valve 8 and drain valve 7 via a power switch 15. A storage 16 stores necessary data for controlling by controller 12.

A rotor-positioning-detector 17 receives a signal from motor 5, and detects a position and rotating speed of a rotor, and then outputs the detection results to controller 12 and to a clothes-load-determiner 18. Based on the data from rotor-positioning-detector 17, clothes-load-determiner 18 determines an amount of clothes, and outputs the result to controller 12. A water level detector 19 detects an amount of water in water tub 1, and outputs the result to controller 12.

A power supply circuit 20, e.g. rectifies and smoothes the commercial power 21 of ac 100V into a dc voltage, and then powers motor driver 14. Power supply circuit 20 also, e.g. lowers that dc voltage to dc 5V to operate controller 12. A power switch 22 is coupled to commercial power 21, and turns on and off the power.

Controller 12 controls the spin of basket 2 by controlling motor 5, thereby varying the centrifugal force working on the cleansing water in basket 2 to cleanse the clothes. Controller 12 varies the centrifugal force by spinning basket 2 intermittently or varying the spin speed periodically.

Figure 3A:
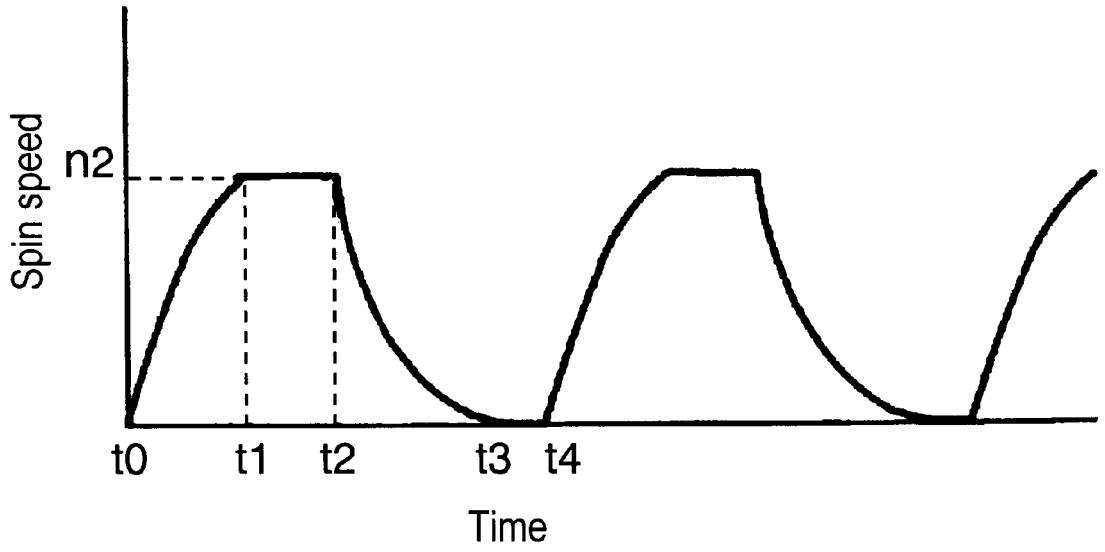
FIG. 3A is an operational timing chart illustrating intermittent spins of the basket of the washing machine shown in FIG. 1
Figure 3B:
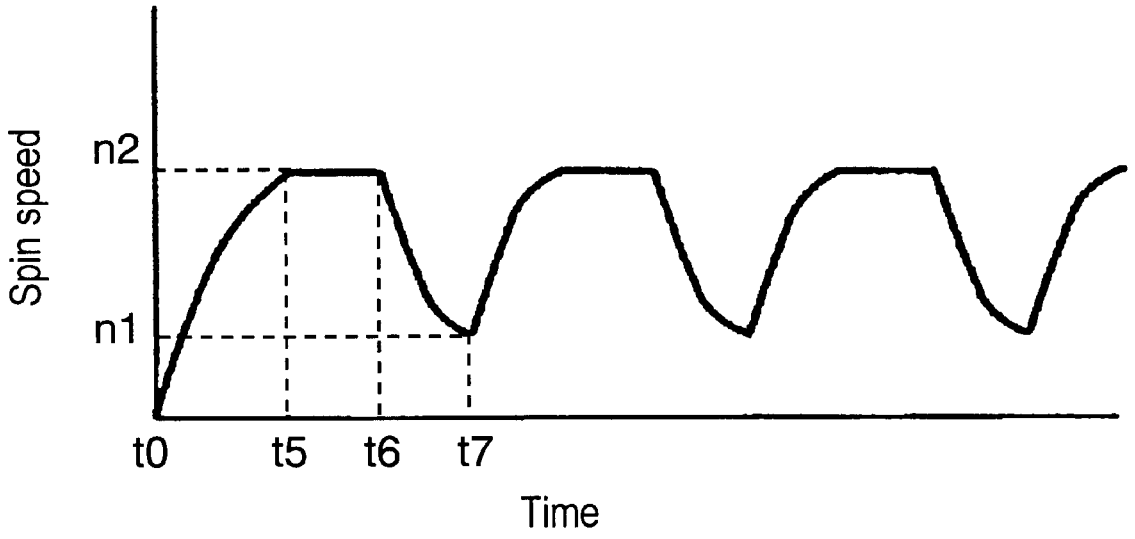
FIG. 3B is an operational timing chart illustrating spins of the basket of the washing machine shown in FIG. 1 with variation of the spinning speed.

A cleansing operation of the structure discussed above is described hereinafter. FIG. 3A shows a variation of spin speed with regard to the time lapse when basket 2 is spun intermittently. FIG. 3B shows a variation of spin speed with regard to the time lapse when basket 2 is spun by varying the spin speed periodically.

Figure 4A:
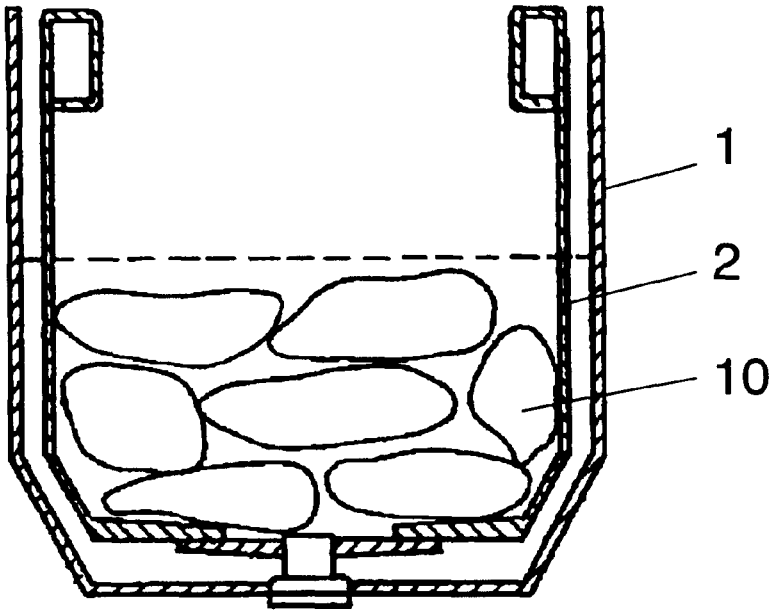
FIG. 4A is a cross section of an essential part of the washing machine when the basket is halted.

First, the intermittent spin of basket 2 is described with reference to FIGS. 3A, 4A and 4B. When basket 2 are halted, clothes 10 is distributed in basket 2 almost uniformly, and the surface of the cleansing water stays level as shown in FIG. 4A. Then as shown in FIG. 3A, the spin speed is increased up to n2 along the time scale from t0 to t1, and the spin speed is maintained at n2 until the time=t2.

Figure 4B:
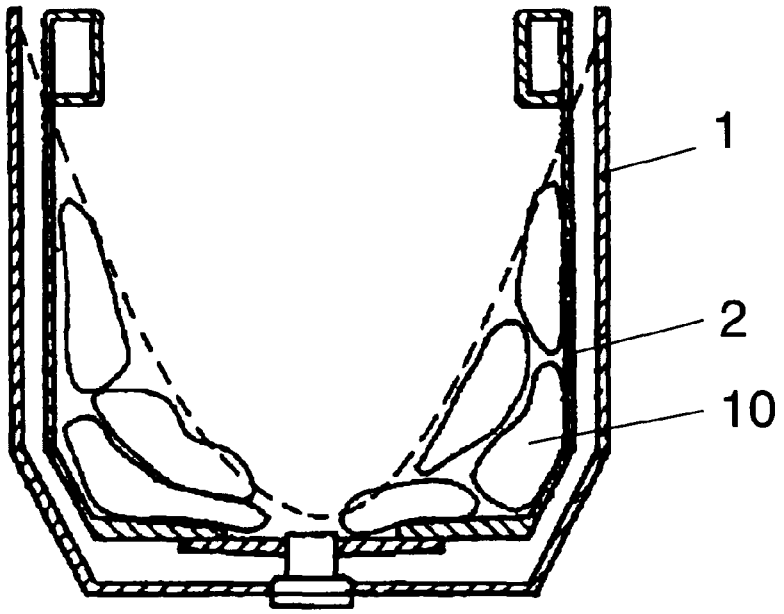
FIG. 4B is a cross section of the essential part of the washing machine when the basket is spun.

When basket 2 spins at n2 spin-speed, centrifugal force works on the clothes and cleansing water therein, and the water surface forms a conical shape as shown by a broken line in FIG. 4B. If soil attached to the clothes has a greater specific gravity than the cleansing water, the soil is drawn toward the outside by the spin. Soil having a lower specific gravity than the cleansing water is drawn inwardly by the spinning.

When controller 12 stops powering motor 5 at time=t2, the spin speed of basket 2 sharply decreases to 0 (zero) at time=t3, where centrifugal force does not work on the clothes nor the cleansing water, i.e. the status returns to that shown in FIG. 4A. Driving of motor 5 re-started at time=t4, and repeat the procedure discussed above is repeated so that basket 2 is spun intermittently. The soil attached to the clothes is thus repeatedly pulled and released.

This intermittent spinning and cleansing power of the detergent causes the soil to be readily removed from the clothes. The centrifugal force removes the soil from the clothes, and draws some of the soil having a greater specific gravity than the cleansing water to the outside, while drawing the soil of a smaller specific gravity to the inside. The clothes are thus cleansed.

The variation of spin speed as shown in FIG. 3A varies the centrifugal force. The surface of the water in basket 2 varies from a level to a conical shape and vice versa as shown in FIG. 4A and FIG. 4B. This change moves the clothes from the center to the circumference and vice versa, which produces a press-washing effect. This effect contributes to removing soil from the clothes.

Those effects discussed above produce a synergistic effect, thereby removing the soil from the clothes efficiently. The clothes receive only the force produced by the moving water, and thus remain free from damage as well as being entangled.

Varying the spin speed of basket 2 periodically is another method to cleanse clothes, which is described hereinafter.

As shown in FIG. 3B, the spin speed of basket 2 is increased along the time scale from t0 to t5. When the spin speed reaches n2, the speed is maintained until time=t6. Then, driving of motor 5 is stopped at time=t6, which lowers the spin speed sharply to n1 at time=t7, where a next driving operation is started.

In this case, controller 12 controls power to motor 5 as follows: motor 5 is powered so that the rotating speed is accelerated from time=t0 to t5, and stays at a constant speed from time=t5 to t6. Then the motor is stopped at time=t6, which lowers the rotating speed sharply to n1 at t7, where the motor is re-powered. This process is stopped so that the spin speed of basket 2 rises and falls between n1 and n2.

This method also produces the same effect discussed previously and shown in FIG. 3A. Because the variation of centrifugal force becomes smaller than in the previous case, the cleansing power per variation cycle decreases. However, frequencies of variation of spin speed are greater than in the previous case. This method can thus often gain stronger cleansing power per period than the previous method. Either one of the methods shown in FIG. 3A and FIG. 3B can be selected as required.

An operation of the washing machine is described with reference to FIG. 1 and FIG. 2.

First, clothes 10 into are loaded basket 2, an then a start-switch (not shown) disposed on operation panel 13 is pressed, which drives motor 5 for a given time via motor driver 14 based on an instruction of controller 12. The operation data of motor 5 during this given time is detected by rotor-positioning-detector 17, and transmitted to clothes-load-determiner 18. Determiner 18 determines load data of the clothes and inputs it to controller 12. One of the load determination methods involves e.g. transition of rotating speed of motor 5 during the given time based on the signals from detector 17, and then the load of the clothes can be determined.

Controller 12 instructs power switch 15 to open water valve 8, which starts supplying water to water tub 1. Water-level-detector 19 monitors a water level of tub 1, and inputs the report to controller 12. When controller 12 determines that the water reached a level appropriate to the clothes load, controller 12 instructs switch 15 to close water valve 8, and stops supplying water. Controller 12 then drives motor 5 via motor driver 14, and moves the process to the cleansing step.

In the cleansing step, controller 12 controls motor 5 to rotate intermittently as shown in FIG. 3A. The maximum spin speed n2 of basket 2 is set based on the water volume, and the maximum spin speed n2 is increased at lower water volume. In other words, when tub 1 contains less water volume, the smaller load is applied to motor 5, thereby increasing the spin speed. When the spin speed is increased, the cleansing water won't splash out from the top of the basket, which allows the spin speed to increase. The centrifugal force increases at the higher spin speed, so that the cleansing power becomes stronger. As a result, a cleansing time can be shortened when water is at a low level.

After the cleansing step is carried out for a given time, drain valve 7 is opened for draining the cleansing water. Then, rinsing and dehydrating steps are carried out before the washing is completed.

As such, according to the first exemplary embodiment, the centrifugal force due to the spinning of basket 2 forces the cleansing water to run through the fibers of clothes, and produces a press-washing effect, whereby soil can be removed from the clothes. The clothes are thus cleansed without being damage, losing their shape or being entangled.

Clothes-load-detector 18 gives the data clothes load to controller 12 so that controller 12 can vary the water level based on the data. As a result, the clothes can be cleansed with an appropriate volume of water, which saves water and detergent.

In this exemplary embodiment, basket 2 having dehydrating holes is described as an example; however, a basket doubling as a spin-drier with no holes can also produce the same effect.

Exemplary Embodiment 2

Figure 5:
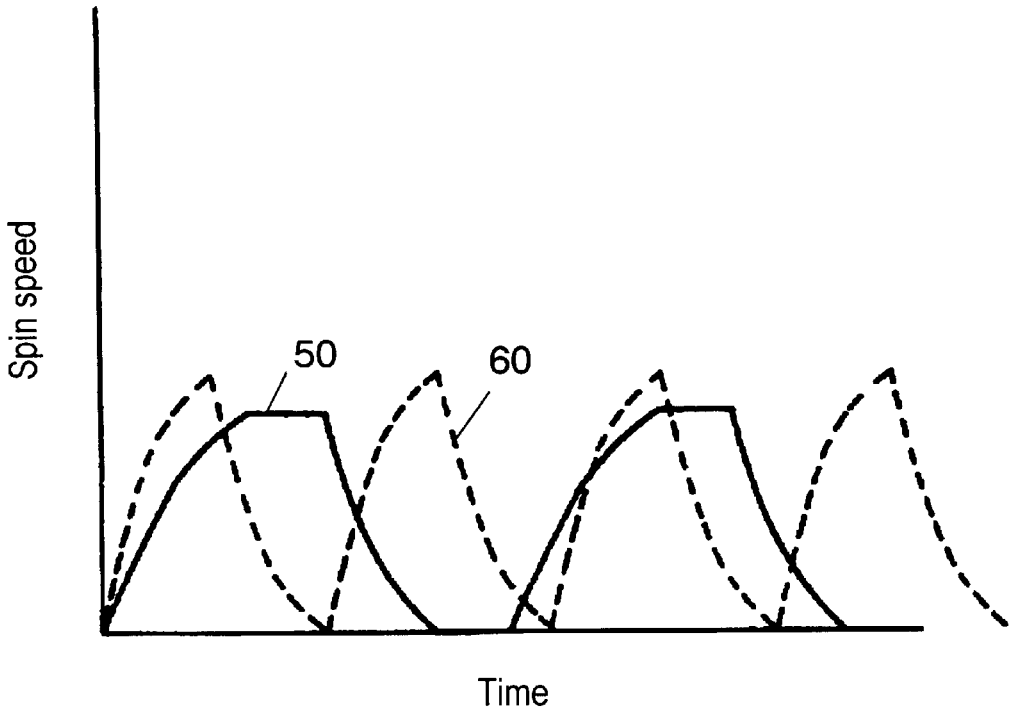
FIG. 5 is an operational timing chart of a washing machine in accordance with a second exemplary embodiment of the present invention.

FIG. 5 is an operational timing chart of a washing machine in accordance with the second exemplary embodiment of the present invention.

The points in the second exemplary embodiment which are different from the first embodiment involve the manner of driving basket 2 which doubles as the spin-drier. Other structures remain the same as in the first embodiment.

Controller 12 shown in FIG. 2 varies at least respective periods of driving and halting of basket 2 in an intermittent driving manner, or varies cycles of varying a spin speed of basket 2, based on a water level, the clothes load, and the kind of clothes.

In this embodiment, a method of cleansing is changed responsive to the kind of clothes. For instance, a woolen sweater has totally different delicacy of fiber and constitution of soil from those of a cotton underwear. When mechanical force is impressed to the woolen sweater, fibers are entangled with each other, and crinkled, while the cotton is not so delicate as the woolen sweater. The cotton underwear is soiled with fatty skin, but the woolen sweater is lightly soiled. Accordingly, the woolen sweater does not demand so much cleansing power, and is desirably washed free from moving. On the other hand, the cotton underwear may be moved during the washing and it demands cleansing power.

FIG. 5 illustrates the specific cleansing ways for these two types of clothes. FIG. 5 shows how to control the spin speed of basket 2. Solid lines 50 show the spin-speed-control for cleansing the woolen sweater, and broken lines 60 show that for the cotton underwear. In the case of the woolen sweater, a start-up spin speed varies in a narrow range, and the frequency of repetition is controlled to be a small number so that the sweater does not move so much. In the case of the cotton underwear, the start-up speed varies in a wide range, and the frequency of repetition is increased so that the underwear moves well. As such, the manner of varying the spin speed of basket 2 produces an appropriate cleansing method for the respective clothes.

Regarding the water level, when the water stays at a lower level, an inertia moment of basket 2 containing the clothes and water becomes smaller. The spin speed can be thus controlled little by little. The cycle of spin speed variation can be shortened in order to increase the cleansing power so that the cleansing period can be shortened. The cycle of spin speed variation can be thus changed, whereby an appropriate cleansing method is produced as well as the cleansing period can be shortened.

Exemplary Embodiment 3

Figure 6:
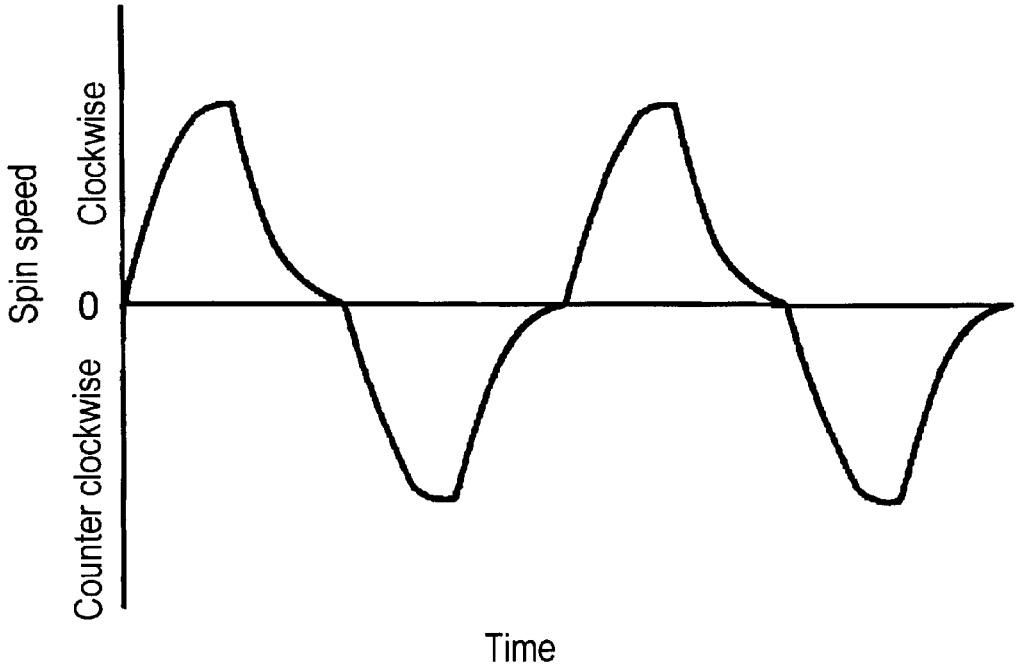
FIG. 6 is an operational timing chart of a washing machine in accordance with a third exemplary embodiment of the present invention.

FIG. 6 is an operational timing chart of a washing machine in accordance with the third exemplary embodiment of the present invention.

In this third embodiment, a point different from the first embodiment is the manner of spinning basket 2. Other structures remain the same as in the first embodiment.

Controller 12 shown in FIG. 2 can alternate a spin direction of basket 2. An operation of the third exemplary embodiment is described hereinafter. The spin speed of basket 2 is controlled as shown in FIG. 6. The Y-axis of FIG. 6 represents spin speeds, and a speed of clockwise spin increases upwardly from the center, i.e. "0" (zero), while a speed of counterclockwise spin increases downwardly from the center "0" (zero).

First, basket 2 spins clockwise and is the spin is increased in speed, and then stopped. Although the spin is halted, the inertia moment of basket 2 per se keeps basket 2 spinning but with decreasing speed. When the spin speed reaches almost "0" (zero), basket 2 is driven to spin counterclockwise. Then the spin is increased speed and then stopped. The inertia moment of basket 2 keeps basket 2 spinning but with decreasing speed. When the spin speed reaches almost "0" (zero), basket 2 is driven to spin clockwise. One cycle is thus completed.

Repeating this cycle moves the clothes in basket 2 in a more dynamic manner than the one-way spinning method described in the first and second embodiments, which further increases the cleansing power. When basket 2 is halted and the spin speed decreases, braking is applied before the spin speed reaches "0" (zero), and basket 2 is spun in the reverse direction. Then the cleansing power can be still further increased.

In this case, even if the clothes move in a more dynamic manner, the relative locations of clothes with each other are not changed, and therefore, the clothes are still free from damage that the conventional agitating method causes.

In this third exemplary embodiment, controller 12 alternates the spin direction of basket 2 every spin; however, controller 12 can alternate the spin direction after a plurality of spins in the same direction, which also produces the same effect.

Exemplary Embodiment 4

Figure 7:
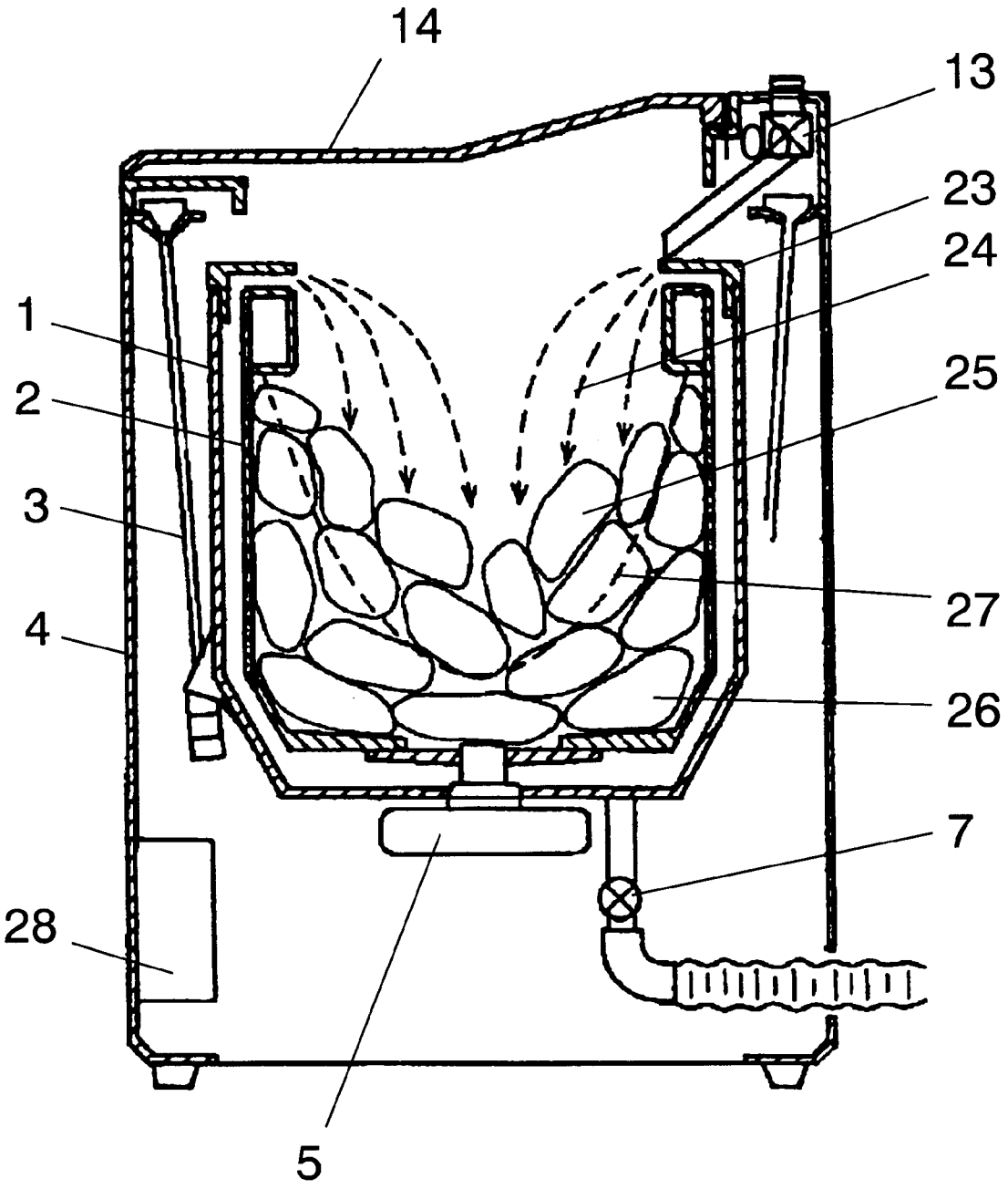
FIG. 7 is a cross section of a washing machine in accordance with a fourth exemplary embodiment of the present invention.
Figure 8:
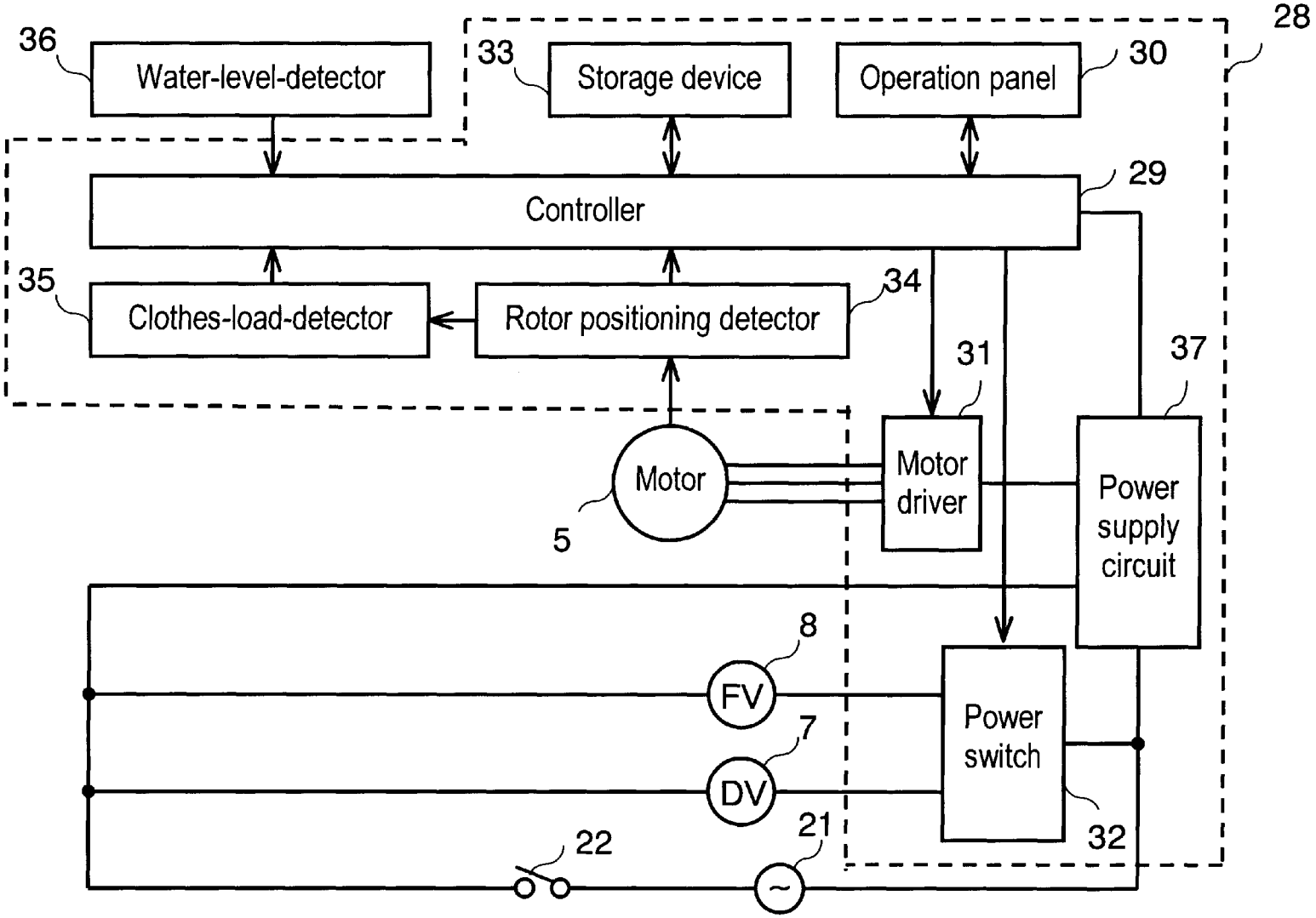
FIG. 8 is a block circuit diagram of the washing machine shown in FIG. 7.

FIG. 7 is a cross section of a washing machine in accordance with the fourth exemplary embodiment of the present invention, and FIG. 8 is a block circuit diagram of the washing machine shown in FIG. 7.

In FIG. 7, a water-guard 23 is disposed on water tub 1. Due to spinning of basket 2, cleansing water rises into an annular space between basket 2 and water tub 1. The rising water forms a waterfall 24 toward the inside of the basket 2, and sprays over the clothes 25 and 26. At this moment, the surface 27 of the cleansing water in basket 2 forms a conical shape as shown in a broken line. In a lower section of the washing machine, a control device 28 for controlling motor 5 is disposed.

Control device 28 shown in FIG. 8 has the following structure:

A controller 29 sequentially controls respective steps of cleansing, rinsing and dehydrating based on a set mode supplied from an operation panel 30. In other words, controller 29 controls motor 5 via a motor driver 31. Controller 29 also controls a water valve 8 and a drain valve 7 via a power switch 32. A storage device 33 stores data necessary for controller 29.

A rotor-positioning-detector 34 receives signals from motor 5, and detects a rotor position and its rotating speed. Detector 34 outputs the results to controller 29 and a clothes-load-determiner 35. Clothes-load-determiner 35 determines the load of the clothes based on the data from detector 34, and outputs the result to controller 29. A water-level-detector 36 detects a water level in water tub 1, and outputs the result to controller 29.

A power-supply-circuit 37 rectifies and smoothes the commercial power 21 of ac 100V into a dc voltage, and then powers motor driver 31. Power-supply-circuit 37 lowers that dc voltage and supplies the lowered voltage to controller 29 and the like.

Controller 29 controls a first step and a second step. The first step is to spin basket 2 and vary the centrifugal force applied to the cleansing water in basket 2, thereby cleansing the clothes. The second step is to spin basket 2 and spray the cleansing water rising from between water-guard 23 and basket 2 into basket 2, thereby cleansing the clothes. The first and second steps are combined so that the clothes can be cleansed. Other structures remain the same as the first exemplary embodiment.

An operation of the fourth exemplary embodiment is described hereinafter.

FIG. 7 illustrates a case where a bulk of clothes are cleansed. When the clothes are cleansed, the surface of cleansing water forms a conical shape as shown in a broken line in FIG. 7. Clothes 26 are immersed in the cleansing water, while clothes 25 are dipped but appear therefrom. Centrifugal force works on clothes 26 through the cleansing water, thereby cleansing the clothes 26 in the same manner as in the first exemplary embodiment. However, clothes 25 cannot be cleansed at this location.

The second step discussed above is then introduced, i.e. the spinning of basket 2 allows the cleansing water to form the waterfall 24 and spray over clothes 25 from the location of water guard 23. Since basket 2 spins, centrifugal force allows the cleansing water to run through clothes 25, thereby cleansing them.

When a small amount of clothes are loaded, the first step can cleanse the clothes, in the same manner as in the first exemplary embodiment.

How to use the first and second steps properly is discussed hereinafter in connection with the operation of the washing machine.

The clothes are put into basket 2, and then a start-switch (not shown) disposed on operation panel 30, which drives motor 5 for a given time via motor driver 31 based on an instruction of controller 29. The operation data of motor 5 during this given time is detected by rotor positioning detection 34, and transmitted to clothes-load-determiner 35. Determiner 35 determines load data of the clothes and inputs it to controller 29.

Controller 29 compares an input signal from determiner 35 with the data stored in storage device 33 to determine which step, i.e. the first or the second step, is desirably taken, and then determines a water level and a spin speed. Controller 29 instructs power switch 32 to open water valve 8, which supplies water up to the determined level, and then controller 29 instructs motor driver 31 to drive motor 5 intermittently at the determined spin speed.

As such, the first and second steps can be combined so that various amount of clothes can be cleansed with the appropriate amount of water for the respective amounts of clothes. The clothes are, of course, cleansed free without damage.

Exemplary Embodiment 5

Figure 9:
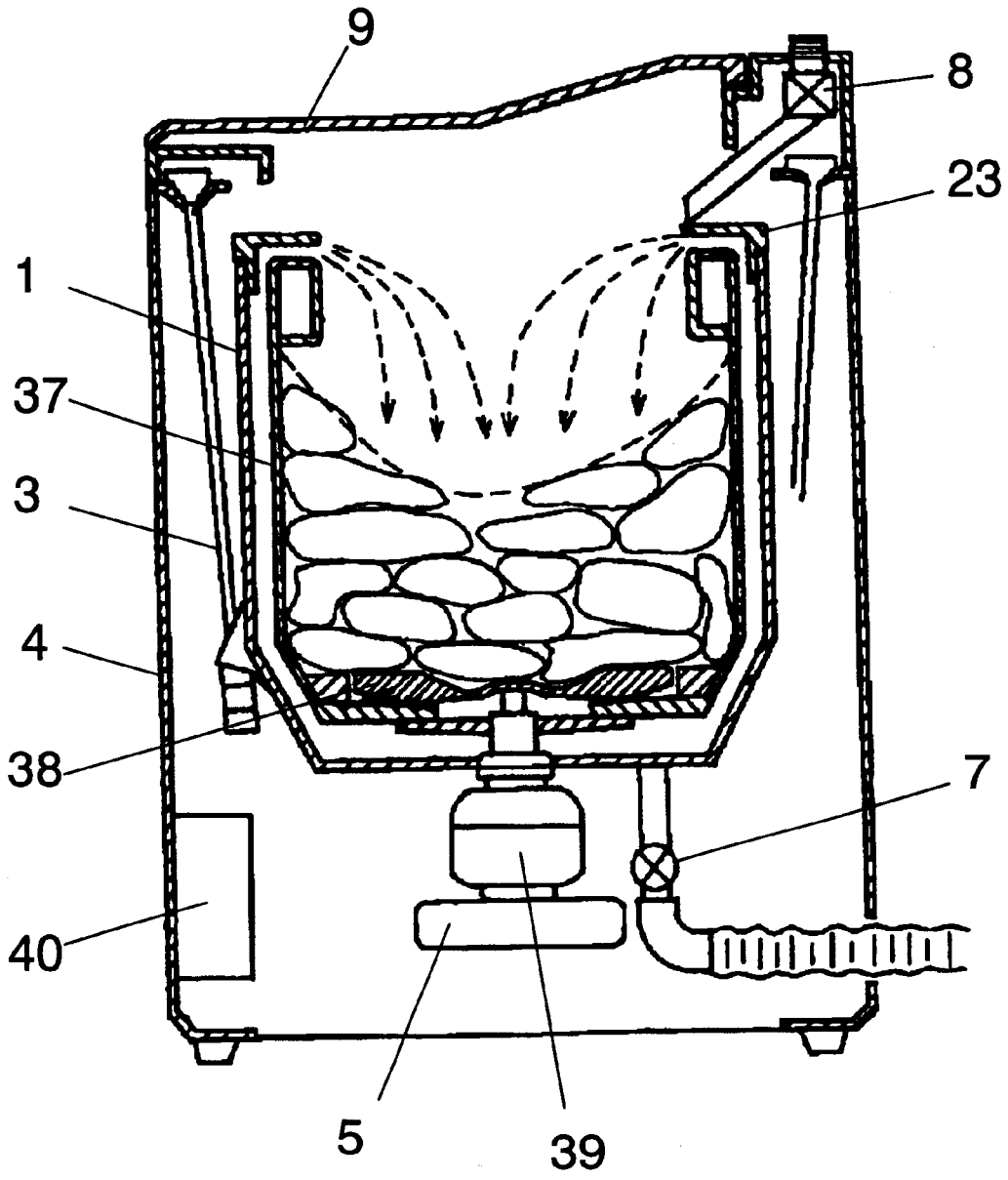
FIG. 9 is a cross section of a washing machine in accordance with a fifth exemplary embodiment of the present invention.

FIG. 9 is a cross section of a washing machine in accordance with the fifth exemplary embodiment of the present invention.

In FIG. 9, a washing basket 37 doubling as a spin-drier has a pulsater 38 disposed rotatably on a bottom section thereof. Motor 5 drives pulsator 38 or basket 37 via a speed reduction mechanism 39 doubling as a clutch. A control device 40 controls a rotating speed of motor 5.

Control device 40 is structured as shown in FIG. 8 the same as in the fourth exemplary embodiment. This fifth exemplary embodiment comprises the following three steps:

Step 1. Spinning basket 37, and varying the centrifugal force working on he cleansing water in basket 37, thereby cleansing the clothes;

Step 2. Spinning basket 37, and spraying the cleansing water into basket 37, thereby cleansing the clothes;

Step 3. Spinning pulsater 38, thereby cleansing the clothes. Other structures are the same as in the fourth exemplary embodiment.

An operation of the fifth exemplary embodiment is described hereinafter.

Responsive to an amount of clothes, one of the above three steps is selected, or two or three steps are combined to cleanse the amount of clothes. For instance, Step 1 and Step 2 are combined when delicate clothes are cleansed, which is same as in the fourth exemplary embodiment.

When extremely soiled clothes are cleansed, Step 1 and Step 2 are combined, and further Step 3, i.e. agitating the clothes with the pulsator, is added in order to sufficiently remove soil. In this case, only Step 3 may work, but a combination of Step 1 and Step 2 can increase cleansing power and decrease damage.

As such, the fifth exemplary embodiment proves that the washing machine of the present invention can accommodate a wide range of clothes, such as from a small amount to a bulk of clothes and from delicate clothes to extremely soiled clothes.

As discussed above, the washing machine of the present invention comprises a water tub, a washing basket doubling as a spin-drier disposed rotatably in the water tub, a driving machine for driving the basket, and a control device for controlling the driving machine. The control device varies the centrifugal force working on the cleansing water, thereby cleansing the clothes. The centrifugal force is generated by spinning the basket. According to this structure, the clothes only receive water-moving-force generated by the centrifugal force, therefore and, the clothes can be cleansed without being from damaged or entangled.

The present invention also drives the basket intermittently, or varies the spin speed thereof thereby varying the centrifugal force dynamically so that the surface of the cleansing water varies from a level to a conical shape. As a result, soil can be removed effectively.

What is claimed is:

1. A washing machine comprising:

a water tub;

a washing basket doubling as a spin-drier and disposed in said water tub;

a driving machine for driving said washing basket; and a control device for controlling said driving machine;

wherein said washing basket is rotatably mounted in said water tub for rotation about a generally vertical axis; and wherein, during washing said control device spins said washing basket such that cleansing water in said washing basket forms a generally conical shape, and so as to vary centrifugal force working on the cleansing water in said basket for cleansing articles to be cleansed.

2. The washing machine as defined in claim 1, wherein said control device is so structured to perform one of spinning said basket intermittently and varying a spin speed of said basket.

3. The washing machine as defined in claim 2, further comprising a water-level detector for detecting a level of water in said basket, wherein said control device varies the spin speed of said basket responsive to a water level detected by said detector.

4. The washing machine as defined in claim 2, further comprising an article-load-determiner, wherein said control device varies the water level responsive to a load of articles to be cleansed determined by said determiner.

5. The washing machine as defined in claim 2, wherein said control device is so structured to vary one of, at least one of a driving period and a halt period, and a variation cycle of the spin speed based on at least one of the water level, load of articles to be cleansed and a kind of articles to be cleansed.

6. The washing machine as defined in claim 2 wherein said control device is so structured to perform one of altering a spin direction of said basket after each spin and altering a spin direction in an intermittent driving manner after each plurality of spins in one direction.

7. The washing machine as defined in claim 1, further comprising a water-level detector for detecting a level of water in said basket, wherein said control device varies the spin speed of said basket responsive to a water level detected by said detector.

8. The washing machine as define in claim 7 wherein said control device is so structured to perform one of altering a spin direction of said basket after each spin and altering a spin direction in an intermittent driving manner after each plurality of spins in one direction.

9. The washing machine as defined in claim 1, further comprising an article-load-determiner, wherein said control device varies the water level responsive to a load of articles to be cleansed determined by said determiner.

10. The washing machine as define in claim 9 wherein said control device is so structured to perform one of altering a spin direction of said basket after each spin and altering a spin direction in an intermittent driving manner after each plurality of spins in one direction.

11. The washing machine as defined in claim 1, wherein said control device is so structured to vary one of, at least one of a driving period and a halt period, and a variation cycle of the spin speed based on at least one of the water level, load of articles to be cleansed and a kind of articles to be cleansed.

12. The washing machine as define in claim 11 wherein said control device is so structured to perform one of altering a spin direction of said basket after each spin and altering a spin direction in an intermittent driving manner after each plurality of pins in one direction.

13. The washing machine as defined in claim 1 wherein said control device is so structured to perform one of altering a spin direction of said basket after each spin and altering a spin direction in an intermittent driving manner after each plurality of spins in one direction.

14. A washing machine comprising:

(a) a water tub;

(b) a water guard disposed at a top section of said tub;

(c) a washing basket doubling as a spin-drier rotatably disposed in said water tub;

(d) a driving machine for driving said washing basket; and (e) a control device for controlling said driving machine, wherein said control device performs the following two steps:

(e-1) spinning said washing basket, and varying centrifugal force working on cleansing water in said basket for cleansing articles to be cleansed; and (e-2) spinning said washing basket, and spraying cleansing water from between said water-guard and said basket into said basket for cleansing articles to be cleansed, wherein said control device is so structured to perform one of selecting one of said two steps and combining said two steps for cleansing articles to be cleansed.

15. A washing machine comprising:

(a) a water tub;

(b) a water guard disposed at a top section of said tub;

(c) a washing basket doubling as a spin-drier rotatably disposed in said water tub;

(d) a pulsator disposed rotatably on a bottom face of said washing basket;

(e) a driving machine for driving said washing basket and said pulsator;

(f) a control device for controlling said driving machine; wherein said control device performs the following three steps:

(f-1) spinning said washing basket, and varying centrifugal force working on cleansing water in said basket for cleansing articles to be cleansed; and (f-2) spinning said washing basket, and spraying cleansing water from between said water guard and said basket into said basket for cleansing articles to be cleansed, and (f-3) spinning said pulsator for cleansing articles to be cleansed, wherein said control device is so structured to perform one of selecting one of said three steps and combining at least two steps out of said three steps for cleansing articles to be cleansed.

* * * * *